US010895075B1

(12) United States Patent
Inzeo et al.

(10) Patent No.: US 10,895,075 B1
(45) Date of Patent: Jan. 19, 2021

(54) LIGHTWEIGHT CONCRETE NAILER FORM

(71) Applicant: Metal-Era, Inc., Waukesha, WI (US)

(72) Inventors: Joseph A. Inzeo, West Allis, WI (US); Eric W. Godfrey, Brookfield, WI (US); Peter H. Kastner, Germantown, WI (US)

(73) Assignee: METAL-ERA, INC., Waukesha, WI (US)

( * ) Notice: Subject to any disclaimer, the term of this patent is extended or adjusted under 35 U.S.C. 154(b) by 0 days.

(21) Appl. No.: 16/512,454

(22) Filed: Jul. 16, 2019

(51) Int. Cl.

| | |
|---|---|
| ***E04C 3/293*** | (2006.01) |
| ***E04B 5/29*** | (2006.01) |
| ***E04G 9/02*** | (2006.01) |
| *E04G 13/04* | (2006.01) |

(52) U.S. Cl.
CPC ..... *E04C 3/293* (2013.01); *E04B 5/29* (2013.01); *E04G 9/02* (2013.01); *E04G 13/04* (2013.01)

(58) Field of Classification Search
CPC ..... E04G 13/04; E04B 5/29; E04C 3/293
USPC ..... 52/364, 370, 373, 374, 376, 367, 368, 52/371, 835, 846, 839, 834, FOR. 107, 52/FOR. 110, 12; 428/595, 603
See application file for complete search history.

(56) References Cited

U.S. PATENT DOCUMENTS 1,655,406 A * 1/1928 Bennett ..... E04F 13/0803 52/365
1,761,288 A * 6/1930 Baum ..... E06B 1/6092 52/215
3,221,671 A * 12/1965 Collins ..... B61D 17/10 105/422
3,343,320 A * 9/1967 Krajcinovic ..... E04C 3/294 52/252
3,813,834 A * 6/1974 Davis, Jr. ..... B28B 23/00 52/223.8

(Continued)

FOREIGN PATENT DOCUMENTS

DE 3026732 A1 * 2/1982 ..... E04C 3/20
GB 1038720 A * 8/1966 ..... E04G 13/04

(Continued)

OTHER PUBLICATIONS

Metal-Era Print Approval of Box Eliminailer. A Box Eliminailer product was sold more than one year before the date of filing of the present application.

*Primary Examiner* — Michael Safavi
(74) *Attorney, Agent, or Firm* — Donald J. Ersler

(57) ABSTRACT

A lightweight concrete nailer form preferably includes a semi-tubular member and a plurality of cross members. The semi-tubular member includes a bottom wall, a first sidewall, a second sidewall, a first upper flange and a second upper flange. A height of the first and second sidewalls may also increase over a length of the semi-tubular member to form a tapered semi-tubular member. A plurality of openings are preferably formed through the bottom wall and the first side wall for the flow of lightweight concrete. The cross member preferably includes a bottom flange, an upright member and a top flange. An opening is formed through the upright member for the flow of lightweight concrete. The plurality of cross members fit inside the semi-tubular member. The semi-tubular member may be stacked with a second semi-tubular member. A cover plate may be attached to a top of the semi-tubular member.

20 Claims, 8 Drawing Sheets

(56) References Cited

U.S. PATENT DOCUMENTS 4,385,476 A * 5/1983 Slager ..... E04B 5/14 52/634
4,720,957 A * 1/1988 Madray ..... E04B 1/24 52/846
5,590,505 A * 1/1997 Bogle ..... E04B 2/766 52/376
5,713,176 A * 2/1998 Hunt ..... E04B 2/789 52/376
6,301,854 B1 * 10/2001 Daudet ..... E04B 5/10 52/262
6,502,363 B1 * 1/2003 Roth ..... E04B 9/18 52/714
7,574,838 B2 * 8/2009 Maisch ..... H01L 27/10897 52/506.07
8,056,291 B1 * 11/2011 diGirolamo ..... E04B 5/19 52/250
8,448,395 B2 * 5/2013 Ivarsson ..... E04B 2/767 52/210
2004/0074200 A1 * 4/2004 Attalla ..... E04B 2/789 52/846
2006/0174583 A1 * 8/2006 Brady ..... E04B 2/7457 52/846
2008/0209832 A1 * 9/2008 Near ..... E04B 2/7433 52/481.1
2010/0126106 A1 * 5/2010 Ivarsson ..... E04B 2/767 52/696
2010/0170172 A1 * 7/2010 Klein ..... E04B 2/7411 52/232

FOREIGN PATENT DOCUMENTS

JP 01075763 A * 3/1989 ..... E04C 3/30
KR 102007464 B1 * 8/2010 ..... E04C 3/293
KR 2017001244 U * 4/2017 ..... E04G 13/04
KR 1904115 B1 * 10/2018 ..... E04C 3/293
KR 102144045 B1 * 8/2020 ..... E04C 3/293
WO WO-2017188721 A1 * 11/2017 ..... E04G 13/04

* cited by examiner

LIGHTWEIGHT CONCRETE NAILER FORM

BACKGROUND OF THE INVENTION

1. Field of the Invention

The present invention relates generally to building construction and more specifically to a lightweight concrete nailer form, which becomes a durable nailer after being filled with lightweight concrete.

2. Discussion of the Prior Art

The prior art does not appear to disclose a lightweight concrete nailer form. Metal-Era has disclosed a metal nailer having a rectangular cross section. However, the Metal-Era metal nailer is not designed to retain a quantity of lightweight concrete.

Accordingly, there is a clearly felt need in the art for a lightweight concrete nailer form, which becomes a durable nailer after being filled with lightweight concrete.

SUMMARY OF THE INVENTION

The present invention provides a lightweight concrete nailer form, which becomes a durable nailer after being filled with lightweight concrete. The lightweight concrete nailer form preferably includes a semi-tubular member and a plurality of cross members. The semi-tubular member includes a cross section having a bottom wall, a first sidewall, a second sidewall, a first upper flange and a second upper flange. The first sidewall extends upward from a first edge of the bottom wall and the second sidewall extends upward from the second edge of the bottom wall. The first sidewall preferably includes an angled member and a straight member. The angled member extends inward from the first edge of the bottom wall. The straight member extends upward from a top of the angled member. However, the first sidewall could also be completely straight as the second sidewall. In a second embodiment, a height of the first and second sidewalls increase over a length to form a tapered semi-tubular member. A plurality of first screw holes are formed through the bottom wall adjacent the first sidewall and a plurality of second screw holes are formed through the bottom wall adjacent the second sidewall.

A top of the first sidewall is terminated with the first upper flange, which extends inward from the first sidewall. A top of the second sidewall is terminated with the second upper flange, which extends inward from the second sidewall. A plurality of bottom openings are formed through bottom wall. A plurality of sidewall openings are formed through the first side wall. The plurality of bottom and sidewall openings allow the flow of lightweight concrete there through. The cross member preferably includes a bottom flange, an upright member and a top flange. The bottom flange extends outward from the upright member in one direction and the top flange extends outward from the upright member in an opposite direction. A cross member opening is formed through the upright member to allow the flow of lightweight concrete there through. The plurality of cross members fit inside the semi-tubular member. The bottom flange is secured to the bottom wall with any suitable fastening method or device. The top flange is secured to the first and second flange upper flanges. The lightweight concrete nailer form may be stacked by screwing a bottom wall of a second lightweight concrete nailer form to first and second flanges of a first lightweight concrete nailer form.

A cover plate is preferably attached to a top of the lightweight concrete nailer form or to a top most concrete nailer, if multiple concrete nailers are stacked. The cover plate preferably includes a top plate, a first guide lip and a second guide lip. The first guide lip extends downward from a first edge of the cover plate and the second guide lip extends downward from a second edge of the cover plate. An inner distance between the first and second guide lips is sized to receive a distance measured across an outside of the first and second sidewalls. A first plurality of slots are formed adjacent the first lip and a second plurality of slots are formed adjacent the second lip to receive a plurality of fasteners. The plurality of fasteners are used to attach the cover plate to the first and second upper flanges.

Accordingly, it is an object of the present invention to provide a lightweight concrete nailer form, which becomes a durable nailer after being filled with lightweight concrete.

These and additional objects, advantages, features and benefits of the present invention will become apparent from the following specification.

DETAILED DESCRIPTION OF THE PREFERRED EMBODIMENTS

Figure 1:
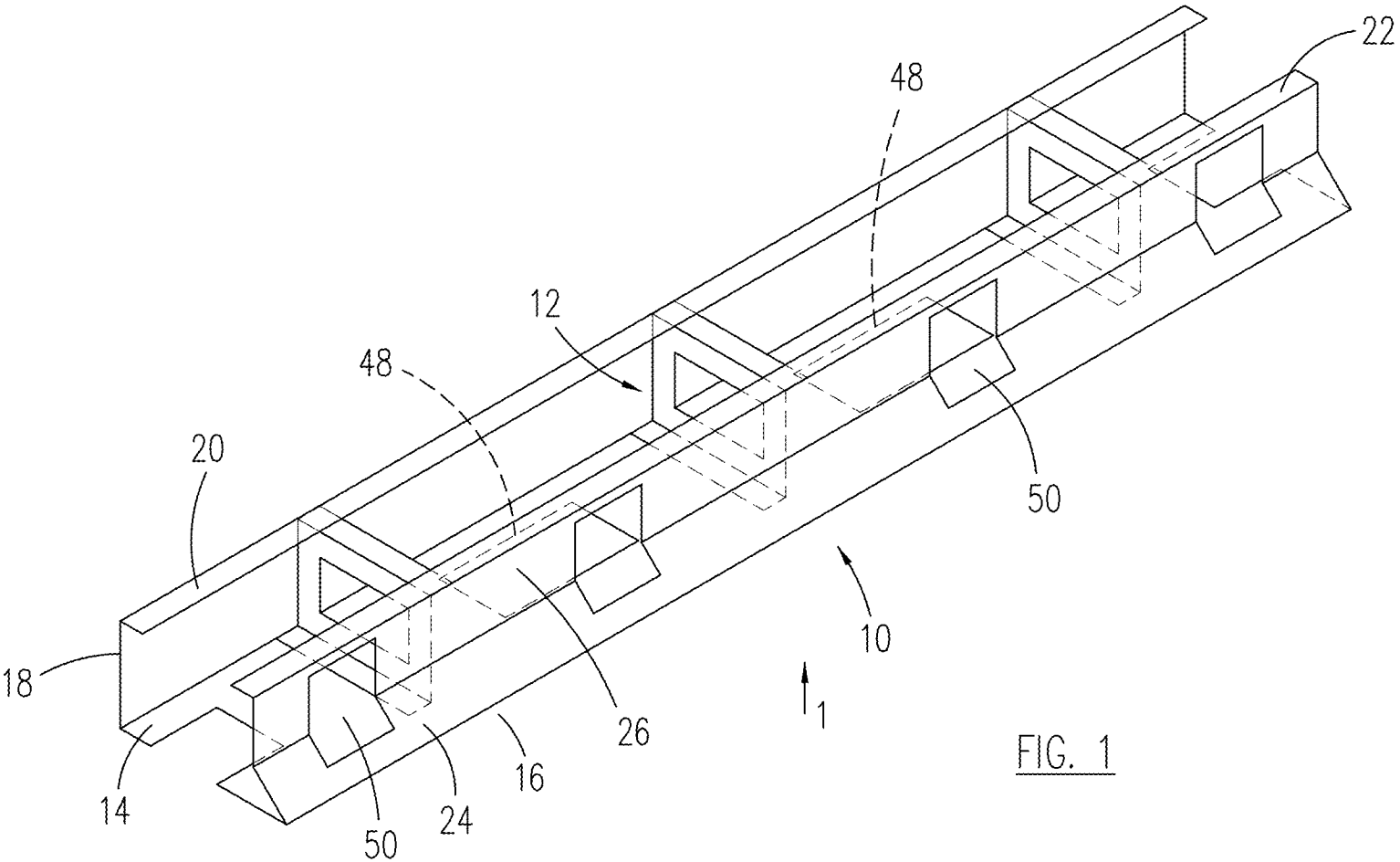
FIG. 1 is a perspective view of a lightweight concrete nailer form in accordance with the present invention.
Figure 2:
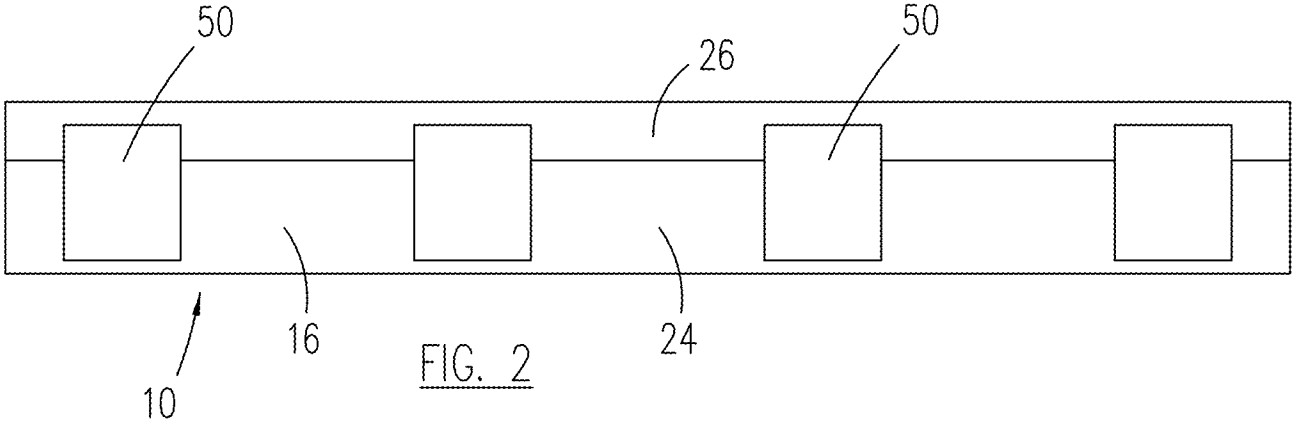
FIG. 2 is a side view of a semi-tubular member of a lightweight concrete nailer form in accordance with the present invention.
Figure 3:
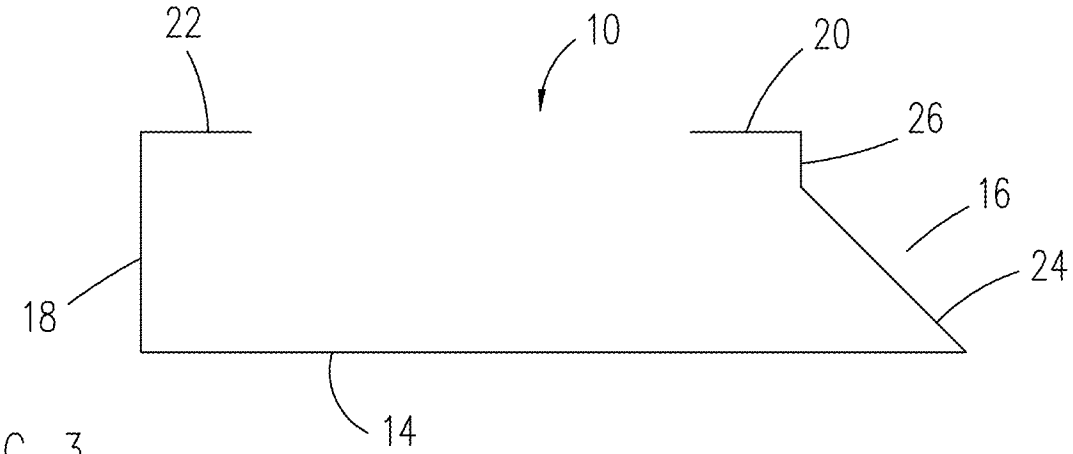
FIG. 3 is an end view of a semi-tubular member of a lightweight concrete nailer form in accordance with the present invention.
Figure 4:
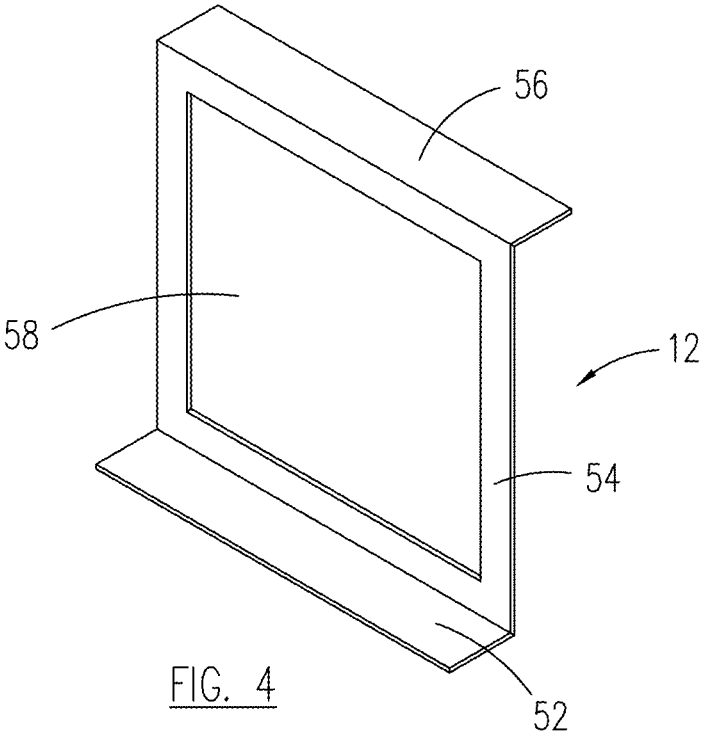
FIG. 4 is a perspective view of a cross member of a lightweight concrete nailer form in accordance with the present invention.

With reference now to the drawings, and particularly to FIG. 1, there is shown a perspective view of a lightweight concrete nailer form 1. With reference to FIGS. 2-4, the lightweight concrete nailer form 1 preferably includes a semi-tubular member 10 and a plurality of cross members 12. The semi-tubular member 10 includes a cross section having a bottom wall 14, a first sidewall 16, a second sidewall 18, a first upper flange 20 and a second upper flange 22. The first sidewall 16 extends upward from a first edge of the bottom wall 14 and the second sidewall 18 extends upward from the second edge of the bottom wall 14. The first sidewall 18 preferably includes an angled member 24 and a straight member 26. The angled member 24 extends inward from the first edge of the bottom wall 14. The straight member 26 extends upward from a top of the angled member 24. However, the first sidewall 16 could also be completely straight as the first sidewall 18.

Figure 5:
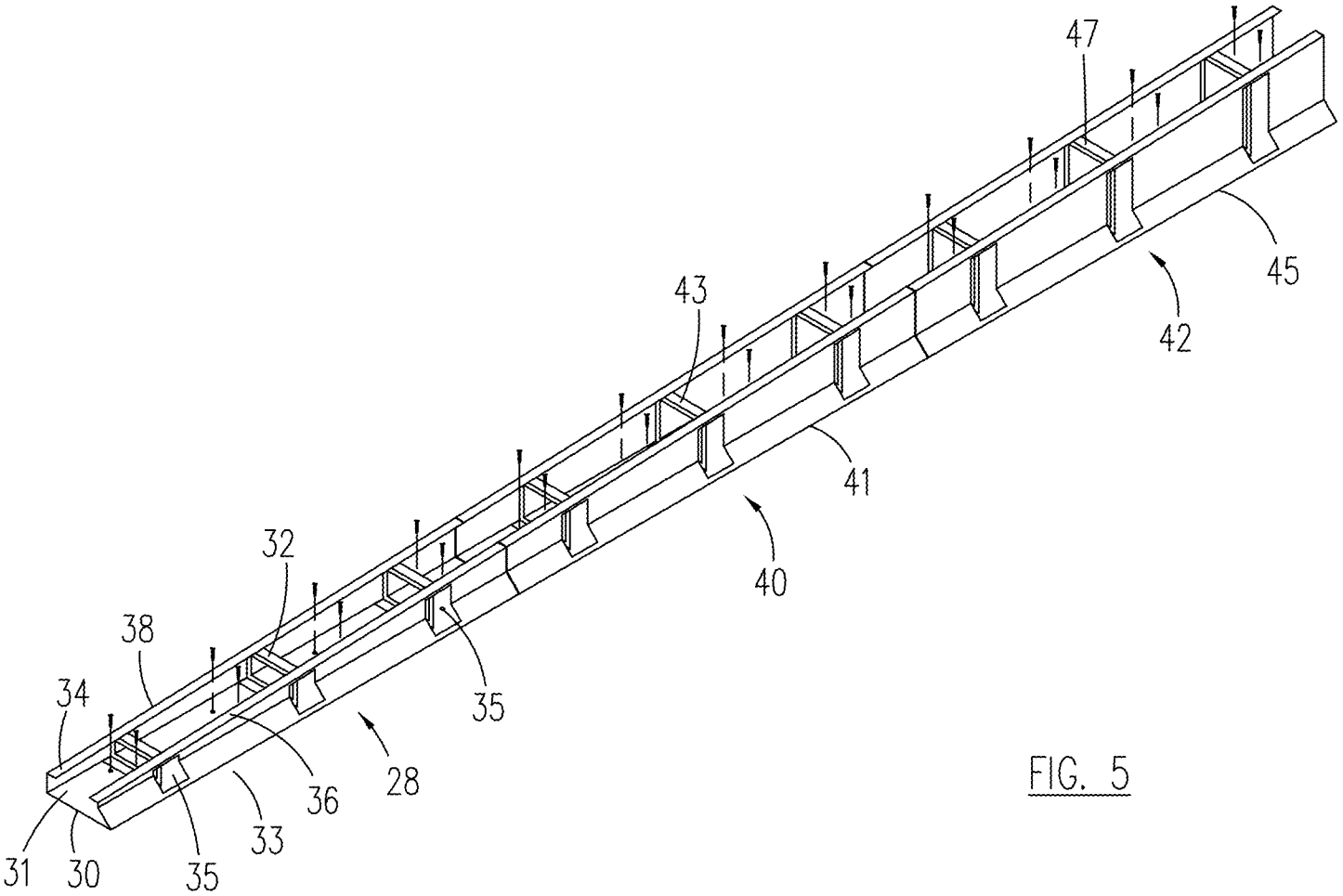
FIG. 5 is a perspective view of three different tapered lightweight concrete nailer forms arranged in series in accordance with the present invention.

With reference to FIG. 5, a first tapered lightweight concrete nailer form 28 includes a first tapered semi-tubular member 30 and a plurality of first tapered cross members 32. The first tapered semi-tubular member 30 includes a bottom wall 31, a first sidewall 33, a second sidewall 34, a sidewall opening 35, a first upper flange 36 and a second upper flange 38. A second tapered lightweight concrete nailer form 40 includes a second tapered semi-tubular member 41 and a plurality of second tapered cross members 43. A third tapered lightweight concrete nailer form 42 includes a third tapered semi-tubular member 45 and a plurality of third tapered cross members 47. The plurality of first, second and third tapered cross members 32, 43, 47 include different heights.

Figure 8:
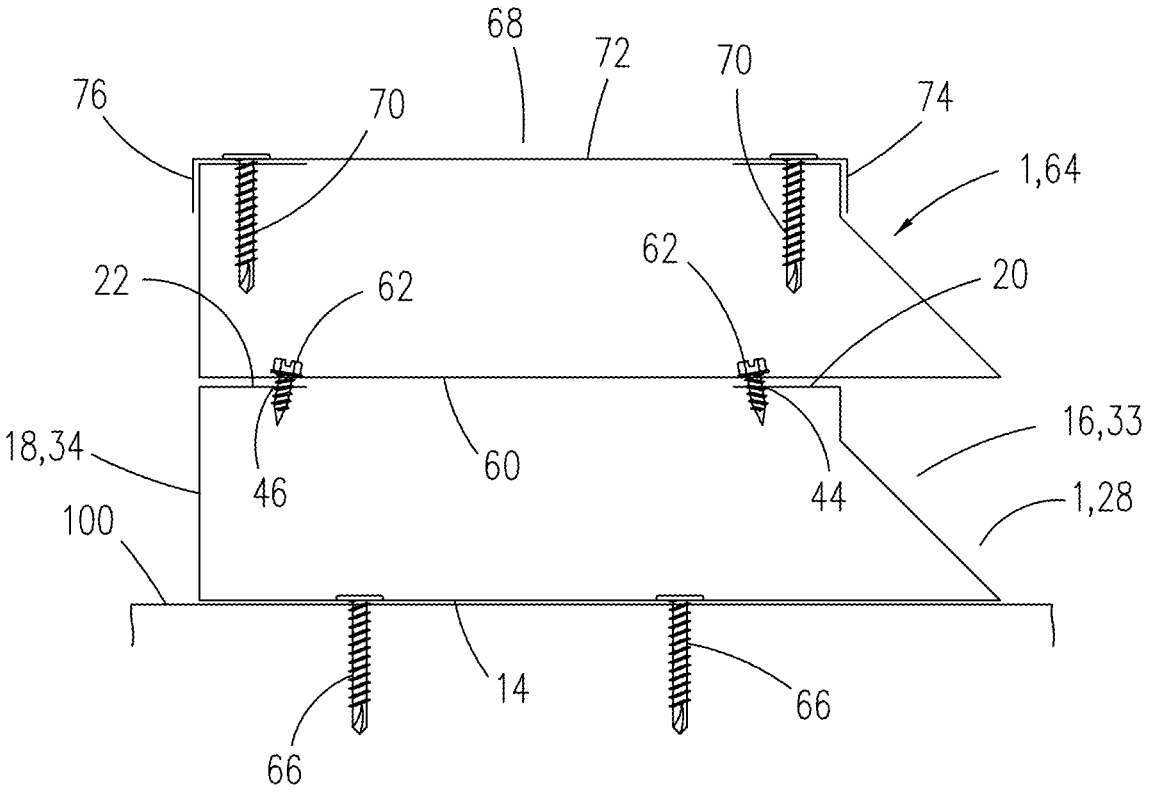
FIG. 8 is an end view of a lightweight concrete nailer form attached to a support surface; a second lightweight concrete nailer form attached to a top of the lightweight concrete nailer form; and a cover attached to a top of the second concrete nailer in accordance with the present invention.

The second tapered semi-tubular member 41 includes a short end, which is placed against a tall end of the first tapered semi-tubular member 30. A height of the tall end of the first tapered semi-tubular member 30 is equal to a height of the short end of the second tapered semi-tubular member 41. The third tapered semi-tubular member 45 includes a short end, which is placed against a tall end of the second tapered semi-tubular member 41. A height of the tall end of the second tapered semi-tubular member 41 is equal to a height of the short end of the third tapered semi-tubular member 45. With reference to FIG. 8, a plurality of first screw holes 44 are formed through the bottom wall 14 adjacent the first sidewall 16, and a plurality of second screw holes 46 are formed through the bottom wall 14 adjacent the second sidewall 18.

A top of the first sidewall 16 is terminated with the first upper flange 20, which extends inward from the first sidewall 16. A top of the second sidewall 18 is terminated with the second upper flange 22, which extends inward from the second sidewall. A plurality of bottom openings 48 are formed through bottom wall 14. A plurality of sidewall openings 50 are formed through the first side wall 16. The plurality of bottom openings 48 and the plurality of sidewall openings 50 allow the flow of lightweight concrete there through.

The cross member 12 preferably includes a bottom flange 52, an upright member 54 and a top flange 56. The bottom flange 52 extends outward from the upright member 54 in one direction and the top flange 56 extends outward from the upright member 54 in an opposite direction. A cross member opening 58 is formed through the upright member 54 to allow the flow of lightweight concrete there through. The plurality of cross members 12 fit inside the bottom wall 14, the first upper flange 20 and the second upper flange 22. The bottom flange 52 is secured to the bottom wall 14 with any suitable fastening method or device, such as metal clinching. The top flange 56 is secured to the first and second flange upper flanges 20, 22 with any suitable fastening method or device, such as metal clinching. A width of the cross member 12 extends from an inner surface of the first sidewall 16 to an inner surface of the second sidewall 18. A height of the cross member 12 extends from a top surface of the bottom wall 14 to a height of the first and second sidewalls 16, 18.

Figure 6:
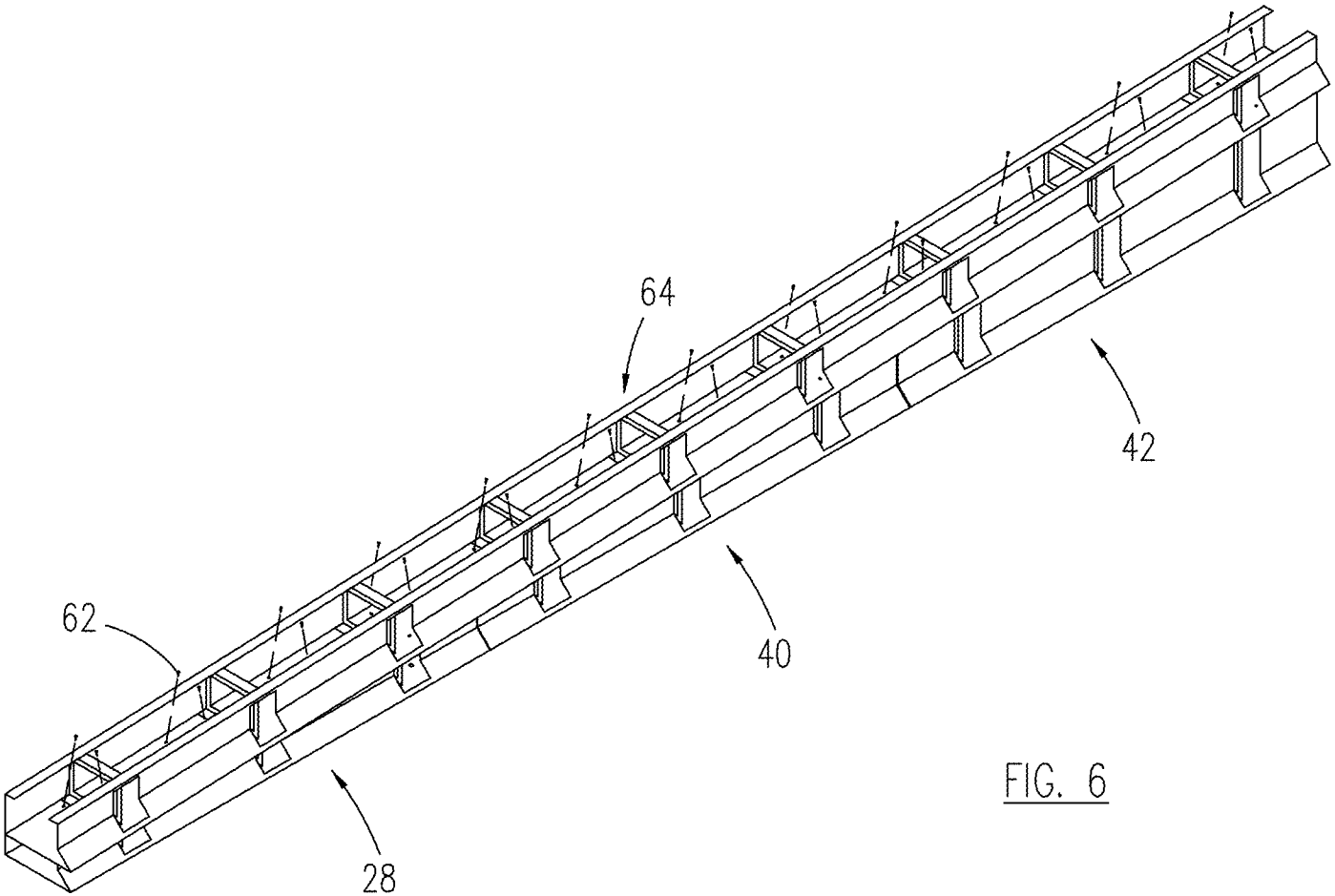
FIG. 6 is a perspective view of a lightweight concrete nailer form attached to a top of three different tapered lightweight concrete nailer forms in accordance with the present invention.

With reference to FIG. 8, the lightweight concrete nailer form 64 may be stacked on to the first tapered lightweight concrete nailer form 28 by screwing a bottom wall 60 of the lightweight concrete nailer form 64 to first and second flanges 36, 38 of the first tapered lightweight concrete nailer form 28 with a plurality of fasteners 62. The first tapered lightweight concrete nailer form 28 is attached to a support surface or roof 100 with a plurality of fasteners 66. With reference to FIG. 6, the first tapered light lightweight concrete nailer form 28, the second tapered lightweight concrete nailer form 40 and the third tapered lightweight concrete nailer form 42 are placed in series. A lightweight concrete nailer form 64 is attached to a top of the first, second and third tapered lightweight concrete nailer forms 28, 40, 42 with the plurality of fasteners 62. The lightweight concrete nailer form 64 has the same length as the first, second and third tapered lightweight concrete nailer forms 28, 40 and 42 combined.

Figure 7:
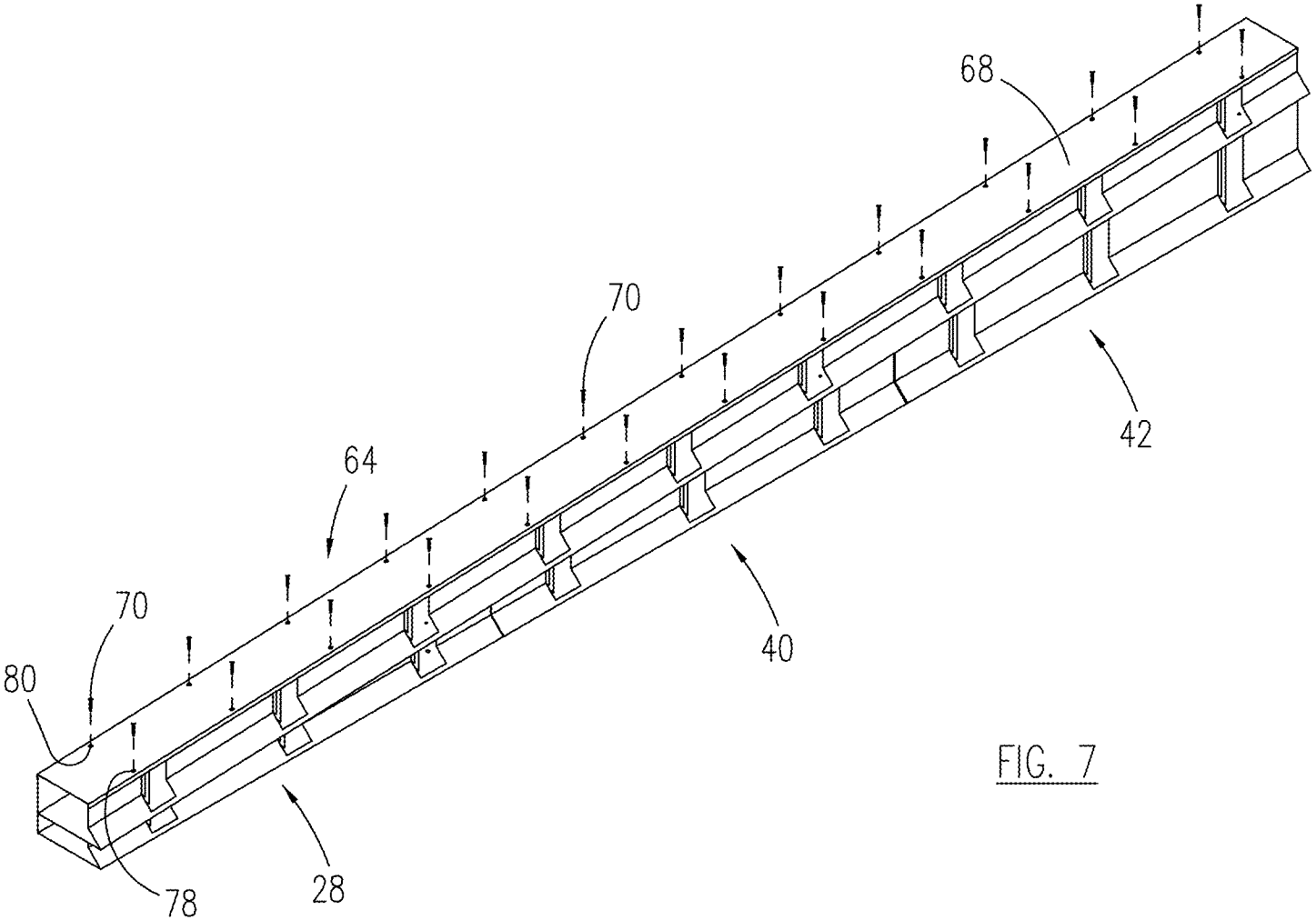
FIG. 7 is a perspective view of a cover retained on a top of a lightweight concrete nailer form and the lightweight concrete nailer form attached to a top of three different tapered lightweight concrete nailer forms in accordance with the present invention.

With reference to FIGS. 7-8, a cover plate 68 is preferably attached to a top of the lightweight concrete nailer form 64, if multiple concrete nailers are stacked with a plurality of fasteners 70. The cover plate 68 preferably includes a top plate 72, a first guide lip 74 and a second guide lip 76. The first guide lip 74 extends downward from a first edge of the cover plate 72 and the second guide lip 76 extends downward from a second edge of the cover plate 72. An inner distance between the first and second guide lips 74, 76 is sized to receive a distance measured across an outside of the first and second sidewalls 16, 18. A first plurality of slots 78 are formed through the cover plate 68, adjacent the first lip 74 and a second plurality of slots 80 are formed through the cover 68, adjacent the second lip 76 to receive the plurality of fasteners 70. The plurality of fasteners 70 are used to attach the cover plate 68 to the first and second upper flanges 20, 22.

Figure 9:
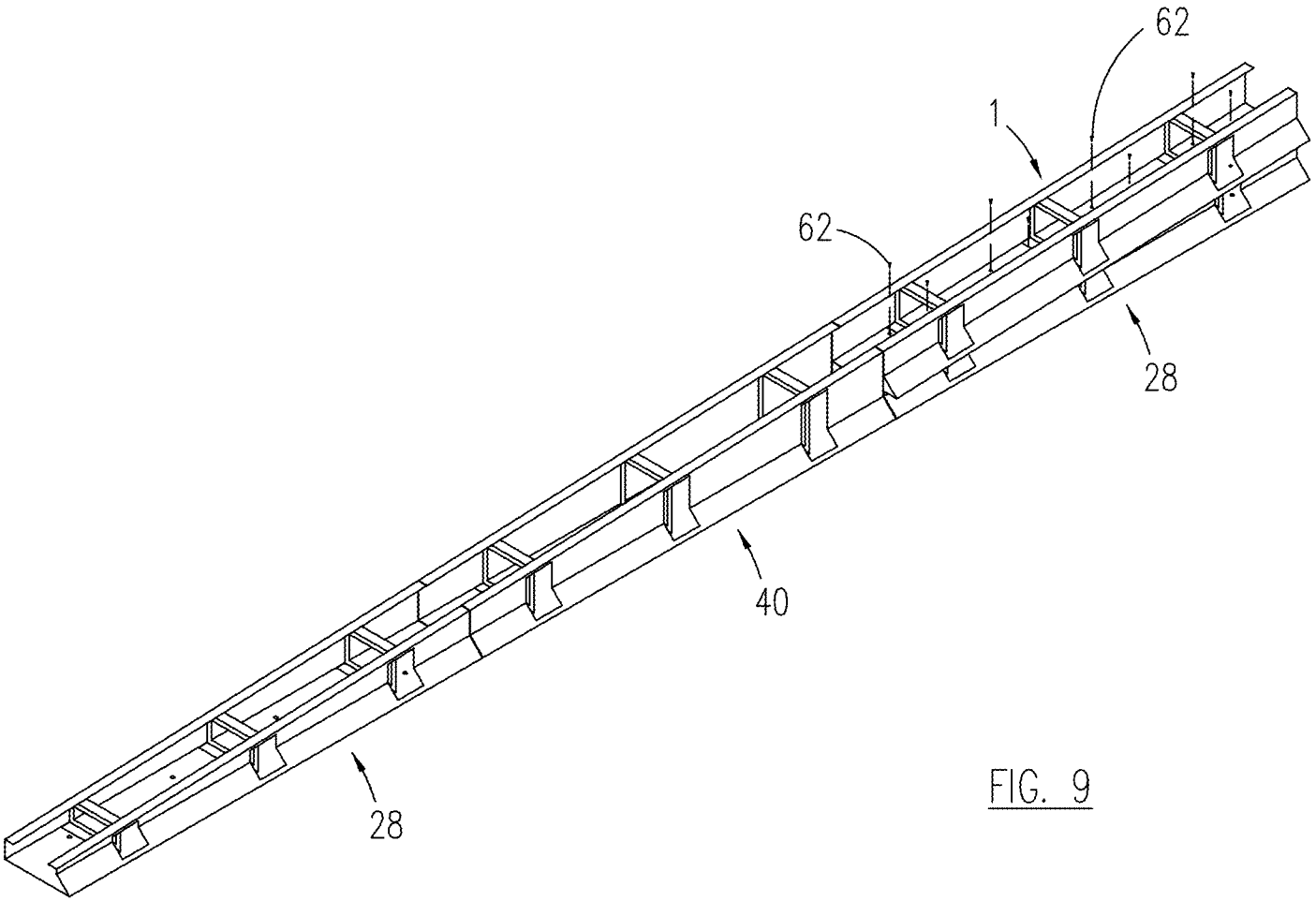
FIG. 9 is a perspective view of a first tapered light lightweight concrete nailer form, a second tapered lightweight concrete nailer form and a second first tapered light weight concrete nailer in series, and a lightweight concrete nailer form placed on top of the second first tapered lightweight concrete nailer form in accordance with the present invention.

With reference to FIG. 9, the first tapered light lightweight concrete nailer form 28, the second tapered lightweight concrete nailer form 40 and a second first tapered light weight concrete nailer 28 are arranged in series and fastened to a support surface. The lightweight concrete nailer form 1 is secured to a top of the second first tapered lightweight concrete nailer form 28 with a plurality of fasteners 62.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A lightweight concrete nailer form, comprising:

a semi-tubular member includes a cross section having a bottom wall, a first sidewall and a second sidewall, said first sidewall extends upward from a first edge of said bottom wall, said second sidewall extends upward from a second edge of said bottom wall; and at least one cross member includes a bottom flange, a top flange and an upright member, said bottom flange extends outward from a bottom of said upright member, said top flange extends outward from a top of said upright member in a direction opposite said bottom flange, said at least one cross member is retained between said first and second sidewalls, a width of one of said at least one cross member extends from an inner surface of said first sidewall to an inner surface of said second sidewall, a height of said one of said at least one cross member extends from a top surface of said bottom wall to a height of said first and second sidewalls.

2. The lightweight concrete nailer form of claim 1 wherein:

at least one bottom opening is formed through said bottom wall.

3. The lightweight concrete nailer form of claim 1 wherein:

said first sidewall includes an angled member and a straight member, said angled member extends inward from said first edge of said bottom wall, said straight member extends upward from a top of said angled member.

4. The lightweight concrete nailer form of claim 1 wherein:

a height of said semi-tubular member is greater at one end than at an opposing end.

5. The lightweight concrete nailer form of claim 1 wherein:

a plurality of bottom holes are formed through said bottom wall to receive a plurality of fasteners.

6. The lightweight concrete nailer form of claim 1, further comprising:

a cover includes a top plate, a first guide lip and a second guide lip, said first guide lip extends downward from a first edge of said cover plate and said second guide lip extends downward from a second edge of said cover plate, wherein said cover is placed over said first and second sidewalls.

7. The lightweight concrete nailer form of claim 1 wherein:

at least one cross member opening is formed through said upright member.

8. The lightweight concrete nailer form of claim 1 wherein:

a height of said one of said at least one cross member does not extend above said first and second sidewalls.

9. A lightweight concrete nailer form, comprising:

a semi-tubular member includes a cross section having a bottom wall, a first sidewall and a second sidewall, said first sidewall extends upward from a first edge of said bottom wall, said second sidewall extends upward from a second edge of said bottom wall, said first sidewall includes an angled member and a straight member, said angled member extends inward from said first edge of said bottom wall, said straight member extends upward from a top of said angled member; and at least one cross member includes a bottom flange and an upright member, said bottom flange extends outward from a bottom of said upright member, said at least one cross member is retained between said first and second sidewalls, said bottom flange is attached to said bottom wall.

10. The lightweight concrete nailer form of claim 9 wherein:

at least one bottom opening is formed through said bottom wall.

11. The lightweight concrete nailer form of claim 9 wherein:

a height of said semi-tubular member is greater at one end than at an opposing end.

12. The lightweight concrete nailer form of claim 9 wherein:

a plurality of bottom holes are formed through said bottom wall to receive a plurality of fasteners.

13. The lightweight concrete nailer form of claim 9, further comprising:

a cover includes a top plate, a first guide lip and a second guide lip, said first guide lip extends downward from a first edge of said cover plate and said second guide lip extends downward from a second edge of said cover plate, wherein said cover is attached to said first and second flanges.

14. The lightweight concrete nailer form of claim 9 wherein:

at least one cross member opening is formed through said upright member.

15. A lightweight concrete nailer form, comprising:

a semi-tubular member includes a cross section having a bottom wall, a first sidewall, a second sidewall, a first flange and a second flange, said first sidewall extends upward from a first edge of said bottom wall, said second sidewall extends upward from a second edge of said bottom wall, said first flange extends inward from a top edge of said first sidewall, said second flange extends inward from a top of said second sidewall; and at least one cross member includes a bottom flange, an upright member and a top flange, said bottom flange extends outward from a bottom edge of said upright member, said top flange extends outward from a top edge of said upright member, at least one cross member opening is formed through said upright member, said at least one cross member is retained between said first and second sidewalls, said bottom flange is attached to said bottom wall, said top flange is attached to said first and second flanges.

16. The lightweight concrete nailer form of claim 15 wherein:

at least one bottom opening is formed through said bottom wall.

17. The lightweight concrete nailer form of claim 15 wherein:

said first sidewall includes an angled member and a straight member, said angled member extends inward from said first edge of said bottom wall, said straight member extends upward from a top of said angled member.

18. The lightweight concrete nailer form of claim 15 wherein:

a height of said semi-tubular member is greater at one end than at an opposing end.

19. The lightweight concrete nailer form of claim 15 wherein:

a plurality of bottom holes are formed through said bottom wall to receive a plurality of fasteners.

20. The lightweight concrete nailer form of claim 15, further comprising:

a cover includes a top plate, a first guide lip and a second guide lip, said first guide lip extends downward from a first edge of said cover plate and said second guide lip extends downward from a second edge of said cover plate, wherein said cover is attached to said first and second flanges.

* * * * *